US007086477B2

(12) United States Patent
Duggan

(10) Patent No.: US 7,086,477 B2
(45) Date of Patent: Aug. 8, 2006

(54) TUBING EXPANSION TOOL

(75) Inventor: Andrew Michael Duggan, Scotland (GB)

(73) Assignee: Weatherford/Lamb, Inc., Houston, TX (US)

( * ) Notice: Subject to any disclaimer, the term of this patent is extended or adjusted under 35 U.S.C. 154(b) by 120 days.

(21) Appl. No.: 10/659,124

(22) Filed: Sep. 10, 2003

(65) Prior Publication Data

US 2004/0045720 A1 Mar. 11, 2004

(30) Foreign Application Priority Data

Sep. 10, 2002 (GB) ..... 0220933.6

(51) Int. Cl.
*E21B 23/00* (2006.01)

(52) U.S. Cl. ..... 166/380; 166/207; 72/320.06

(58) Field of Classification Search ..... 72/370.06, 72/370.08; 166/384, 207, 380, 206, 212
See application file for complete search history.

(56) References Cited

U.S. PATENT DOCUMENTS

| | | | | |
|---|---|---|---|---|
| 761,518 | A | | 5/1904 | Lykken |
| 1,324,303 | A | | 12/1919 | Carmichael |
| 1,545,039 | A | | 7/1925 | Deavers |
| 1,561,418 | A | | 11/1925 | Duda |
| 1,569,729 | A | | 1/1926 | Duda |
| 1,597,212 | A | | 8/1926 | Spengler |
| 1,930,825 | A | | 10/1933 | Raymond |
| 2,383,214 | A | | 8/1945 | Prout |
| 2,499,630 | A | | 3/1950 | Clark |
| 2,627,891 | A | | 2/1953 | Clark |
| 2,663,073 | A | | 12/1953 | Bieber et al. |
| 2,898,971 | A | | 9/1959 | Hempel |
| 3,087,546 | A | | 4/1963 | Wooley |
| 3,195,646 | A | | 7/1965 | Brown |
| 3,467,180 | A | | 9/1969 | Pensolti |
| 3,545,543 | A | * | 12/1970 | Johnson et al. ..... 166/212 |
| 3,818,734 | A | | 6/1974 | Bateman |
| 3,911,707 | A | | 10/1975 | Minakov et al. |
| 4,069,573 | A | | 1/1978 | Rogers, Jr. et al. |
| 4,127,168 | A | | 11/1978 | Hanson et al. |
| 4,159,564 | A | | 7/1979 | Cooper, Jr. |
| 4,288,082 | A | | 9/1981 | Setterberg, Jr. |
| 4,324,407 | A | | 4/1982 | Upham et al. |

(Continued)

FOREIGN PATENT DOCUMENTS

EP 0 961 007 A2 12/1999

(Continued)

OTHER PUBLICATIONS

GB Search Report, Application No. GB 0321157.0, dated Dec. 9, 2003, dated Dec. 9, 2003.

(Continued)

*Primary Examiner*—David Bagnell
*Assistant Examiner*—Daniel P Stephenson
(74) *Attorney, Agent, or Firm*—Patterson & Sheridan, LLP

(57) ABSTRACT

The invention relates to a tubing expansion tool and to a method of expanding tubing. In one embodiment, a tubing expansion tool (10) is disclosed which comprises a body (14) and at least one expansion member (16) radially movably mounted on the body (14) for movement towards an extended configuration describing an expansion diameter for expanding tubing (12) to a predetermined diameter, the expansion member (16) being lockable in the extended configuration. In further embodiments, the expansion member (16) is biased radially inwardly; the expansion member (16) is moveable in response to both an applied mechanical force and an applied fluid pressure force; and the expansion member (16) is pivotably mounted with respect to the body (14).

31 Claims, 9 Drawing Sheets

U.S. PATENT DOCUMENTS

| | | | | |
|---|---|---|---|---|
| 4,429,620 | A | 2/1984 | Burkhardt et al. | |
| 4,531,581 | A | 7/1985 | Pringle et al. | |
| 4,588,030 | A | 5/1986 | Blizzard | |
| 4,697,640 | A | 10/1987 | Szarka | |
| 4,848,469 | A | 7/1989 | Baugh et al. | |
| 5,271,472 | A | 12/1993 | Leturno | |
| 5,409,059 | A | 4/1995 | McHardy | |
| 5,435,400 | A | 7/1995 | Smith | |
| 5,472,057 | A | 12/1995 | Winfree | |
| 5,560,426 | A | 10/1996 | Trahan et al. | |
| 5,685,369 | A | 11/1997 | Ellis et al. | |
| 5,901,787 | A | 5/1999 | Boyle | |
| 6,021,850 | A | 2/2000 | Wood et al. | |
| 6,098,717 | A | 8/2000 | Bailey et al. | |
| 6,325,148 | B1 | 12/2001 | Trahan et al. | |
| 6,425,444 | B1 | 7/2002 | Metcalfe et al. | 166/387 |
| 6,446,323 | B1 | 9/2002 | Metcalfe et al. | |
| 6,457,532 | B1 | 10/2002 | Simpson | 166/380 |
| 6,457,533 | B1 | 10/2002 | Metcalfe | |
| 6,527,049 | B1 | 3/2003 | Metcalfe et al. | |
| 6,543,816 | B1 | 4/2003 | Noel | |
| 6,629,568 | B1 * | 10/2003 | Post et al. | 166/382 |
| 6,702,029 | B1 | 3/2004 | Metcalfe et al. | |
| 2002/0163192 | A1 | 11/2002 | Coulon et al. | |
| 2003/0111234 | A1 * | 6/2003 | McClurkin et al. | 166/384 |
| 2003/0150608 | A1 * | 8/2003 | Smith et al. | 166/118 |
| 2003/0168222 | A1 * | 9/2003 | Maguire et al. | 166/380 |
| 2003/0230410 | A1 * | 12/2003 | Underhill | 166/381 |
| 2004/0020660 | A1 * | 2/2004 | Johnson et al. | 166/384 |
| 2004/0159446 | A1 * | 8/2004 | Haugen et al. | 166/384 |
| 2004/0177953 | A1 * | 9/2004 | Wubben | 166/207 |
| 2005/0045342 | A1 * | 3/2005 | Luke et al. | 166/384 |

FOREIGN PATENT DOCUMENTS

| | | |
|---|---|---|
| GB | 1 485 099 | 9/1977 |
| GB | 2 086 282 | 5/1982 |
| GB | 2 320 734 | 7/1998 |
| GB | 2 383 361 | 6/2003 |
| GB | 2 388 137 | 11/2003 |
| WO | WO 84/00120 | 1/1984 |
| WO | WO 93/24728 | 12/1993 |
| WO | WO 99/18328 | 4/1999 |
| WO | WO 99/23354 | 5/1999 |
| WO | WO 00/37766 | 6/2000 |
| WO | WO 01/38693 | 5/2001 |
| WO | WO 02/059456 A1 * | 8/2005 |

OTHER PUBLICATIONS

Search Report of GB App. No. GB0220933.6 dated Nov. 26, 2002.

U.S. Appl. No. 09/469,643, Melcalfe et al.

* cited by examiner

Fig,8

TUBING EXPANSION TOOL

BACKGROUND OF THE INVENTION

1. Field of the Invention

The present invention relates to a tubing expansion tool. In particular, but not exclusively, the present invention relates to a tubing expansion tool including an expansion member which is radially moveable.

2. Description of the Related Art

A number of different tools have been proposed for carrying out expansion of downhole tubing such as expandable bore-lining tubing. The applicant's International Patent Publication No. WO 00/37766 discloses a rotary expansion tool including a number of rollers mounted on radially moveable pistons. Fluid pressure urges the pistons radially outwardly, to bring the rollers into contact with tubing to be expanded. The tool is then rotated and advanced axially through the tubing to expand the tubing to a greater internal diameter.

The rollers are compliant such that if the tool encounters a portion of tubing which cannot be expanded, the rollers can move inwardly to advance through the restriction.

However, although offering numerous advantages, use of a tool with compliant rollers introduces the possibility of the occurrence of irregularities in the internal diameter of the expanded tubing, which may not be appropriate. For example, if it is desired to hang an expandable liner from borehole casing, a portion of the upper end of the liner may be expanded into contact with the casing to provide hanging support for the liner, with another portion of the liner being expanded into contact with the casing to provide a fluid seal between the liner and the casing. Thus, the liner must be expanded to a determined outer diameter; if a compliant tool has been utilised, it cannot be determined that the liner has been expanded to the appropriate diameter.

SUMMARY OF THE INVENTION

It is amongst the objects of embodiments of the present invention to provide tubing expansion tools which allow a predictable degree of diametric expansion of tubing in a downhole environment, which can be easily recovered from tubing during an expansion procedure, and which offer improved flexibility in their methods of activation.

According to a first aspect of the present invention, there is provided a tubing expansion tool comprising:

a body; and at least one expansion member radially movably mounted on the body for movement towards an extended configuration describing an expansion diameter for expanding tubing to a predetermined diameter, the expansion member being lockable in the extended configuration. It is further object of the present invention to utilize a piezoelectric substrate to mount the optical transceiver elements of the planar light-guide circuit correctly in the best transmitting and receiving positions.

According to a second aspect of the present invention, there is provided a method of expanding tubing, the method comprising the steps of:

providing a tubing expansion tool comprising a body and at least one expansion member movably mounted on the body;

moving the expansion member radially outwardly to an extended configuration describing an expansion diameter;

locking the expansion member in the extended configuration; and moving the expansion tool through tubing to be expanded. The feedback control device determines whether the optical transmitter and the optical receiver are disposed at respective optimum positions according to the optical signals received by the optical receiving and transmitting device and the optical receiver, respectively.

Providing a tubing expansion tool with an expansion member which is lockable in an extended configuration allows the internal diameter of the tubing after expansion to be accurately predicted. The expansion member is preferably released from the extended configuration after removal of the tool from the tubing. This allows verification that the expansion member has been correctly locked during the expansion procedure, and thus that expansion to the predetermined diameter has been performed. Alternatively, the expansion member may be releasably lockable in the extended configuration, and may therefore be unlocked whilst located in the tubing. This allows retraction of the expansion member prior to retrieval of the tool to surface.

Preferably, the tool further comprises a locking assembly for locking the expansion member in the extended configuration.

Preferably also, the tool further comprises an activating member for moving the expansion member towards the extended configuration. The activating member may be moveable between a deactivating position and an activating position, in the activating position the activating member maintaining the expansion member in the extended configuration.

Preferably, the activating member is lockable in the activating position, to lock the expansion member in the extended configuration. The activating member may be adapted to be locked in the activating position by the locking assembly.

The locking assembly may include a locking member adapted to engage the activating member when the activating member is in the activating position, to restrain the activating member and thus maintain the expansion member in the extended configuration.

Alternatively, the locking assembly may include a locking member coupled to the activating member and adapted to engage the body or another part of the tool when the activating member is in the activating position, to restrain the activating member against movement with respect to the body.

In a further alternative, the expansion member may be directly lockable in the extended configuration. The locking assembly may therefore comprise a locking member adapted to engage the expansion member when the expansion member is in the extended configuration, or the expansion member may be coupled to the expansion member and may be adapted to engage the body or another part of the tool. Thus, following movement of the expansion member to the extended configuration, the expansion member may be locked against further movement.

In further embodiments, the expansion member may be hydraulically locked in the extended configuration.

The locking assembly may comprise a mechanical, electro-mechanical or hydraulic locking assembly, or a combination thereof. The lock member may be mounted in the tool body, in the activating member, or in an intermediate member between the tool body and the activating member. The locking assembly may comprise a lock member in the form of a snap or lock ring, a latch, lock pin, locking dogs or keys and may be mechanically, electro-mechanically and/or hydraulically actuated.

According to a third aspect of the present invention, there is provided a tubing expansion tool comprising:

a body; and at least one expansion member radially movably mounted on the body for movement between a retracted configuration and an extended configuration describing an expansion diameter for expanding tubing, the expansion member being biased radially inwardly.

According to a fourth aspect of the present invention, there is provided a method of expanding tubing, the method comprising the steps of:

providing a tubing expansion tool comprising a body and at least one expansion member movably mounted on the body; and moving the expansion member radially outwardly to an extended configuration describing an expansion diameter against a biasing force which biases the expansion member radially inwardly.

The expansion member is biased towards the retracted configuration to facilitate removal of the tool from tubing in the event that the tool becomes stuck. For example, to expand tubing from the bottom-up, the tool would be located at the bottom of the tubing and activated to move the expansion member to the extended configuration. The tool would then be drawn upwardly to diametrically expand the tubing. During bottom-up expansion, the tool may encounter tubing regions which cannot be expanded to the desired diameter. By inwardly biasing the expansion member, the expansion member may be retracted to allow the tool to be advanced through the problematic region.

Preferably, the tool further comprises a biasing assembly for biasing the expansion member radially inwardly.

The tool may further comprise an activating member for moving the expansion member towards the extended configuration. The activating member may be moveable between a deactivating position and an activating position, in the activating position the activating member maintaining the expansion member in the extended configuration. When the activating member is in the deactivating position, this de-supports the expansion member and allows the expansion member to be retracted from the extended position. Preferably, the biasing assembly biases the activating member towards the deactivating position.

Alternatively, the biasing assembly may directly bias the expansion member radially inwardly. Thus when the activating member is moved to the deactivating position, the expansion member may be retracted from the extended configuration by the biasing assembly.

The biasing assembly may comprise a mechanically, electro-mechanically, hydraulically or pneumatically actuated biasing member, or a combination thereof. For example, the biasing assembly may include a biasing member in the form of a spring or a sprung member, a solenoid, a piston or any other suitable member for biasing the expansion member. It will be apparent to the skilled person that any suitable alternative biasing member may be employed.

According to a fifth aspect of the present invention, there is provided a tubing expansion tool comprising:

a body;

at least one expansion member radially movably mounted on the body for movement towards an extended configuration describing an expansion diameter for expanding tubing, the expansion member being moveable in response to both:

an applied mechanical force; and an applied fluid pressure force.

According to a sixth aspect of the present invention, there is provided a method of expanding tubing, the method comprising the steps of:

providing a tubing expansion tool comprising a body and at least one expansion member radially movably mounted on the body for movement towards an extended configuration describing an expansion diameter;

moving the expansion member to the extended configuration in response to a selected one or both of an applied mechanical force and an applied fluid pressure force; and moving the expansion tool through the tubing to diametrically expand the tubing.

This provides a tubing expansion tool which may be activated either by application of a mechanical force, by application of a fluid pressure force or by a combination of the two.

The expansion member may be moveable by an activating assembly including an activating member for moving the expansion member towards the extended configuration. The activating member may be moveable between a deactivating position and an activating position, in the activating position, the activating member maintaining the expansion member in the extended configuration. The activating member may be moveable in response to an applied mechanical force or an applied fluid pressure force, or the assembly may include an activating member moveable in response to either an applied mechanical force, an applied fluid pressure force, or a combination of the two. In a further alternative, the activating assembly may include a first activating member moveable in response to an applied mechanical force and a second activating member moveable in response to a fluid pressure force. The first and second activating members may be associated with separate expansion members; thus there may be at least one expansion member moveable to the extended configuration in response to an applied mechanical force, and at least one separate expansion member moveable in response to an applied fluid pressure force.

The mechanical force may be generated by applying weight to the activating member or by otherwise moving the member relative to the body. The fluid pressure force may be generated by circulating fluid through the tool or by supplying hydraulic fluid to the tool, for example via control line. The activating member may comprise a mandrel, a sleeve, pin, rod or other suitable member, or a piston or other fluid activated member. It will be apparent to persons skilled in the art that any suitable alternative activating member may be employed.

Preferably, the expansion member is pivotable relative to the body. The expansion member may be pivotably mounted on the body. The expansion member may therefore be pivotable about the body to move radially towards the extended configuration. Pivotably mounting the expansion member relative to the body allows relatively high expansion ratios of the tubing to be generated, as relatively large radial movement of the expansion member is achievable.

The expansion member may be coupled to an arm or housing pivotably mounted relative to the body, and may comprise a roller, ball or any other suitable member mounted for rotation with respect to the arm. In particular, the expansion member may comprise a generally truncated cone or conical member, rotatably mounted on a spigot defined by the arm.

The expansion member may be mounted for rotation about an axis disposed substantially parallel to a main axis of the body. The roller axis may be inclined to the main axis of the body. Alternatively, the roller may be rotatable about an axis disposed substantially perpendicular to a main axis of the body. Preferably, the tool comprises a plurality of expansion members.

The activating member and/or the expansion member may include a cam surface for urging the expansion member to the expanded configuration. The cam surface may be inclined such that as the activating member is moved to the activating position, the activating member abuts the expansion member and moves the expansion member radially outwardly to the extended configuration. When the activating member is returned to the deactivating position, the expansion member is de-supported, allowing retraction of the expansion member.

Preferably, in use, the expansion member describes an unexpanded diameter less than an unexpanded inner diameter of the tubing. The body may also be of an outer diameter less than the unexpanded inner diameter of the tubing. This allows the tool to be run into and through tubing to be expanded to a desired location, before the tool is activated to expand the tubing. Alternatively, in use, the expansion member may describe an unexpanded diameter greater than or equal to the unexpanded inner diameter of the tubing, and the body may also be of an outer diameter greater than said diameter of the tubing.

The tool is preferably a downhole tool for expanding downhole tubing. The expansion member may be rotatable about an expansion member axis, and said expansion member axis may be inclined with respect to the body of the tool. The expansion member axis may be inclined towards a leading end of the tool. It will therefore be understood that the expansion member may describe a smaller expansion diameter towards the leading end of the tool than towards a trailing end of the tool. Thus the tool may effectively taper towards the leading end.

The above methods may further comprise the steps of:

translating the tool through a restriction defining an internal bore diameter smaller than said expansion member expansion diameter; and then moving the expansion member radially outwardly to said extended configuration.

This may comprise translating the tool through a restriction in an unlined portion of a borehole. It will be understood that an unlined portion of a borehole is a portion in which no downhole tubing has been located. Alternatively or additionally, this may comprise translating the tool through a restriction in the tubing. The tool may therefore have a particular utility where a restriction is encountered, such as a portion of the tubing which cannot be fully expanded, or where a non-expandable downhole tool or component is located in the tubing or the open hole.

The method may comprise expanding an end of the tubing to a greater diameter than a remainder of the tubing, and may comprise forming a bell-bottom in the tubing. A bell-bottom is a portion of the tubing a larger internal diameter than the internal diameter of a remainder of the tubing, optionally also of a larger external diameter than an external diameter of a remainder of the tubing. The method may also comprise as locating a further tubing in said end of the tubing. The further tubing may be expandable and expanded into contact with said end of the tubing, the tubing comprising a casing and the further tubing a liner, for example.

According to a seventh aspect of the present invention, there is provided a tubing expansion tool comprising:

a body; and at least one expansion member pivotably mounted with respect to the body for movement towards an extended configuration describing an expansion diameter for expanding tubing to a predetermined diameter.

BRIEF DESCRIPTION OF THE DRAWINGS

There follows a description of embodiments of the present invention, by way of example only, with reference to the accompanying drawings, in which.

DETAILED DESCRIPTION OF THE PREFERRED EMBODIMENT

Figure 1:
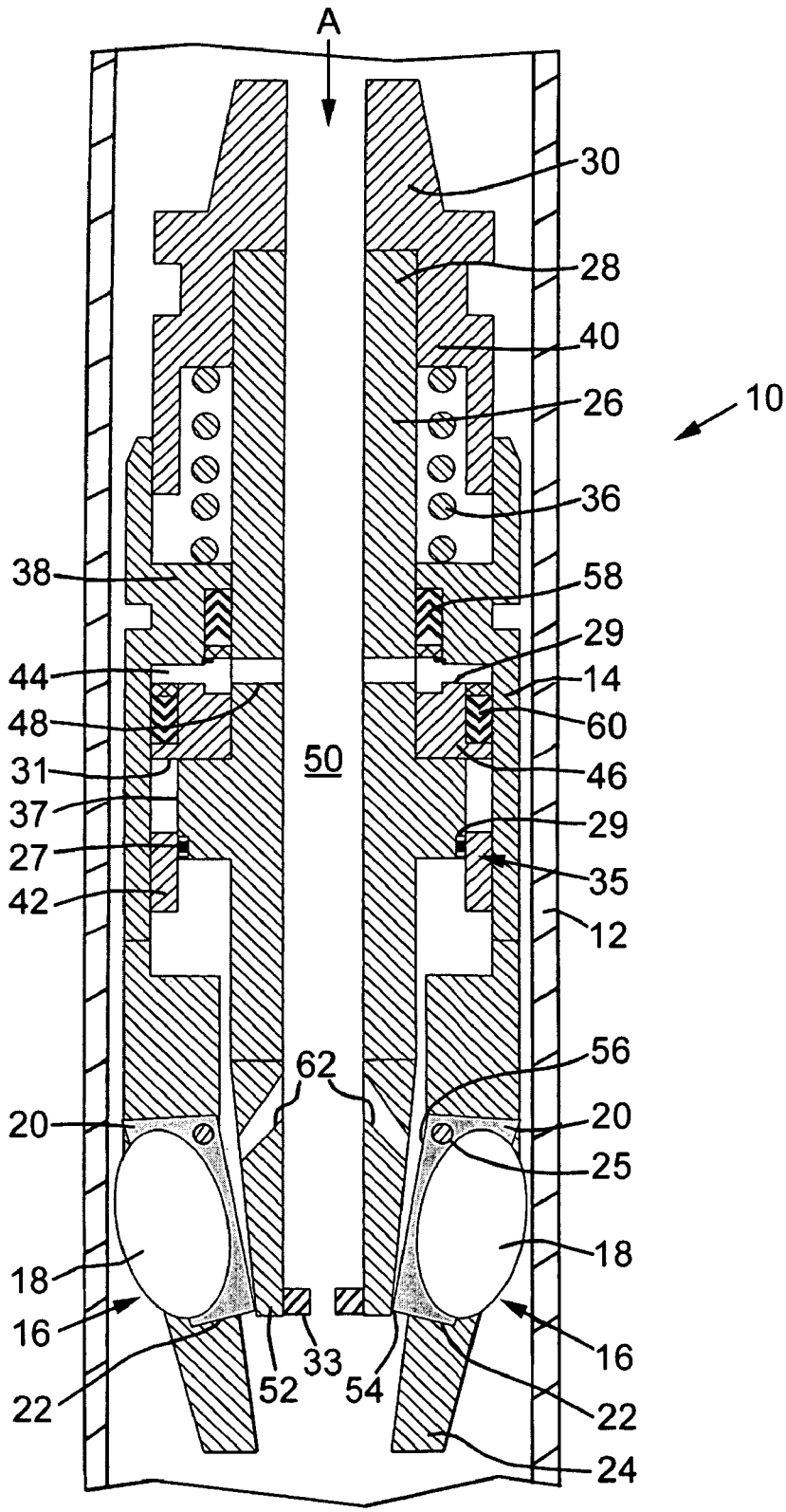
FIG. 1 is a longitudinal sectional view of a tubing expansion tool in accordance with an embodiment of the present invention, shown in a deactivated configuration and located in tubing to be expanded.

Turning firstly to FIG. 1, there is shown a longitudinal sectional view of a tubing expansion tool in accordance with an embodiment of the present invention, indicated generally by reference numeral 10. The tool 10 is shown located in liner 12 which is to be diametrically expanded. The expansion tool 10 is shown in FIG. 1 in a de-activated configuration which allows the tool to be run through the unexpanded liner 12 to the desired location.

Figure 2:
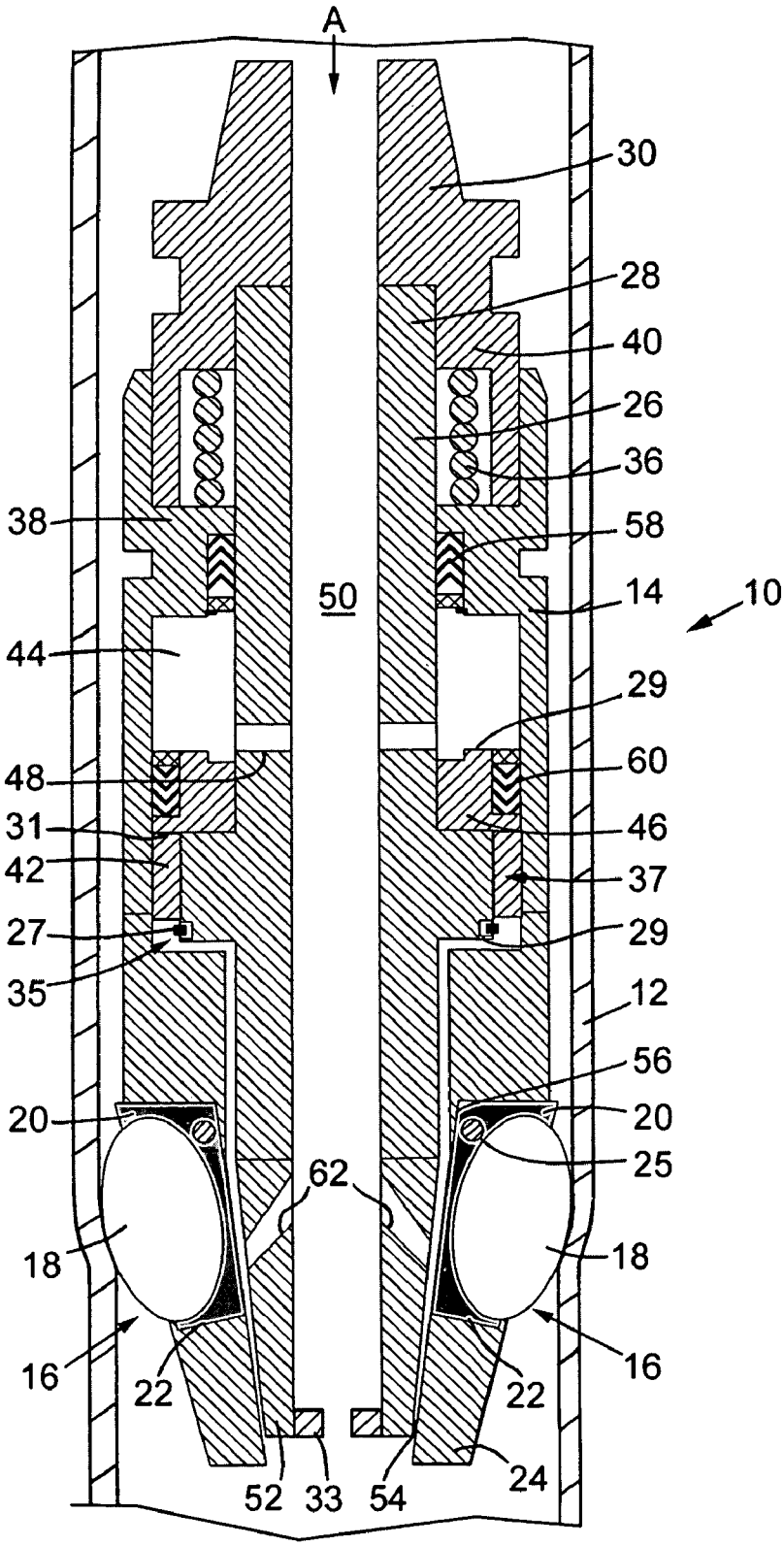
FIG. 2 is a view of the tubing expansion tool of FIG. 1, drawn to a larger scale and shown in an expanded configuration during expansion of the tubing.

The expansion tool 10 comprises a hollow body 14 and four expansion members 16, each radially moveably mounted on the body 14, for movement towards an extended configuration describing an expansion diameter, as shown in FIG. 2. Each expansion member 16 includes an oval section expansion roller 18 mounted on a piston 20, which is radially moveable in slots 22 in a tapered lower end 24 of the body 14. Alternatively, the roller 18 is mounted in a body or housing pivotably mounted to the tool body 14, for example, by a pivot such as the pivot 25 shown in the drawings.

A hollow activating mandrel 26 is mounted in the body 14 for urging the rollers 18 to the extended configuration of FIG. 2. The mandrel 26 is moveable between a deactivating position shown in FIG. 1 and an activating position shown in FIG. 2, in response to either an applied mechanical force, an applied fluid pressure force or a combination of the two.

A lower end 52 of the mandrel 26 is truncated cone-shaped, and defines a cam surface 54 for urging the rollers 18 to the extended configuration, as will be described below. The expansion tool 10 also includes a locking assembly 35 comprising a snap ring 27 located in a groove 29 in the mandrel 26, for locking the rollers 18 in the extended configuration of FIG. 2.

An upper end 28 of the mandrel 26 is coupled to a connecting sub 30 which allows a mechanical force to be exerted on the mandrel 26 to move the mandrel between the deactivating and activating positions. The connecting sub 30 is in-turn coupled to a tubing string (not shown) from which the tool 10 is suspended, and the sub 30 is axially moveable relative to the body 14. The tool 10 also includes a biasing member comprising a spring 36, which biases the mandrel 26 towards the deactivating position of FIG. 1. In the deactivating position, the mandrel 26 de-supports the rollers 18, allowing the rollers to be moved radially inwardly, towards the retracted position of FIG. 1.

The biasing spring 36 is located between a shoulder 38 in the body 14 and a shoulder 40 of the connecting sub 30. As will be described below, when the force on the mandrel 26 is removed or reduced, the spring 36 urges the sub 30 and mandrel 26 towards the deactivating position of FIG. 1, to de-support the rollers 18.

The tool body 14 includes an annular guide ring 42 which guides the mandrel 26 and a cylinder 44 is defined by an annular floating piston 46 mounted between the mandrel 26 and the body 14. The mandrel 26 includes a number of ports 48 extending through the wall of the mandrel which allow fluid communication between a central bore 50 of the tool 10 and the cylinder 44. Seals (not shown) are provided between the piston 46 and a shoulder 37 of the mandrel 26 such that the piston defines an upper piston area 29 and a smaller, lower piston area 31, and further seals 58, 60 are provided above and below the cylinder 44.

The seal 58, 60 ensure that pressure is applied to the upper piston area 29 and that there is no leakage into the chamber of spring 36, or past the piston 46. Also, a flow restriction nozzle 33 is provided at the lower end of the mandrel 26. As will be described below, both the differential piston area and the nozzle 33 allow movement of the mandrel 26 by application of fluid pressure, to urge the rollers 18 to the extended configuration. Flow ports 62 in the cone 52 allow flow of cooling fluid to the rollers 18 during expansion of the liner 12.

A method of operation of the expansion tool 10 will now be described, with reference to FIGS. 1 and 2.

In a top-down expansion procedure, the tool 10 is run into a well borehole on coiled tubing and into the liner 12. When the tool 10 has been located at the top of the liner 12, fluid is circulated through the bore 50 of the tool, exiting through the nozzle 33. The nozzle 33 restricts fluid flow and increases the back-pressure of fluid in the bore 50, pressurising fluid in the cylinder 44 relative to the fluid acting on the lower piston area 31. The combination of the back-pressure of the fluid in the cylinder 44 and the differential piston area urges the piston 46 downwardly, carrying the mandrel 26 downwardly to the activating position of FIG. 2. During this movement, the cam surface 54 of the mandrel cone 52 abuts the roller pistons 20, urging the pistons radially outwardly in their slots 22, to the extended configuration of FIG. 2.

At the same time, the tool 10 is rotated by an appropriate downhole motor, and the rollers 18 are progressively moved outwardly to describe an expansion diameter greater than the unexpanded internal diameter of the tubing 12. When the mandrel 26 has moved fully downwardly, the snap ring 27 locks out against the guide ring 42, to lock the mandrel 26 against return movement to the deactivating position of FIG. 1. The mandrel 26 is thus locked in the activating position, and maintains the rollers 18 in the extended configuration of FIG. 1.

The rotating expansion tool 10 is then translated axially through the tubing 12, and the rollers 18 diametrically expand the liner 12 to a greater internal diameter, as shown in FIG. 2. The expansion tool 10 is rotated and translated through the liner 12 to a desired depth, and the expansion tool 10 is then returned to surface. By verifying that the snap ring 27 has locked out to restrain the mandrel 26 in the activating configuration, this indicates to the operator that the rollers 18 were correctly located in the extended configuration during the expansion procedure. Accordingly, this provides an indication that the tubing 12 has been expanded to the desired, predetermined internal diameter described by the rollers 18 in the extended configuration. The snap ring 27 is then released and the mandrel 26 retracts to the deactivating position under the force of the spring 36, thus de-supporting the rollers 18. The rollers 18 can then be returned to the retracted configuration of FIG. 1.

Figure 3:
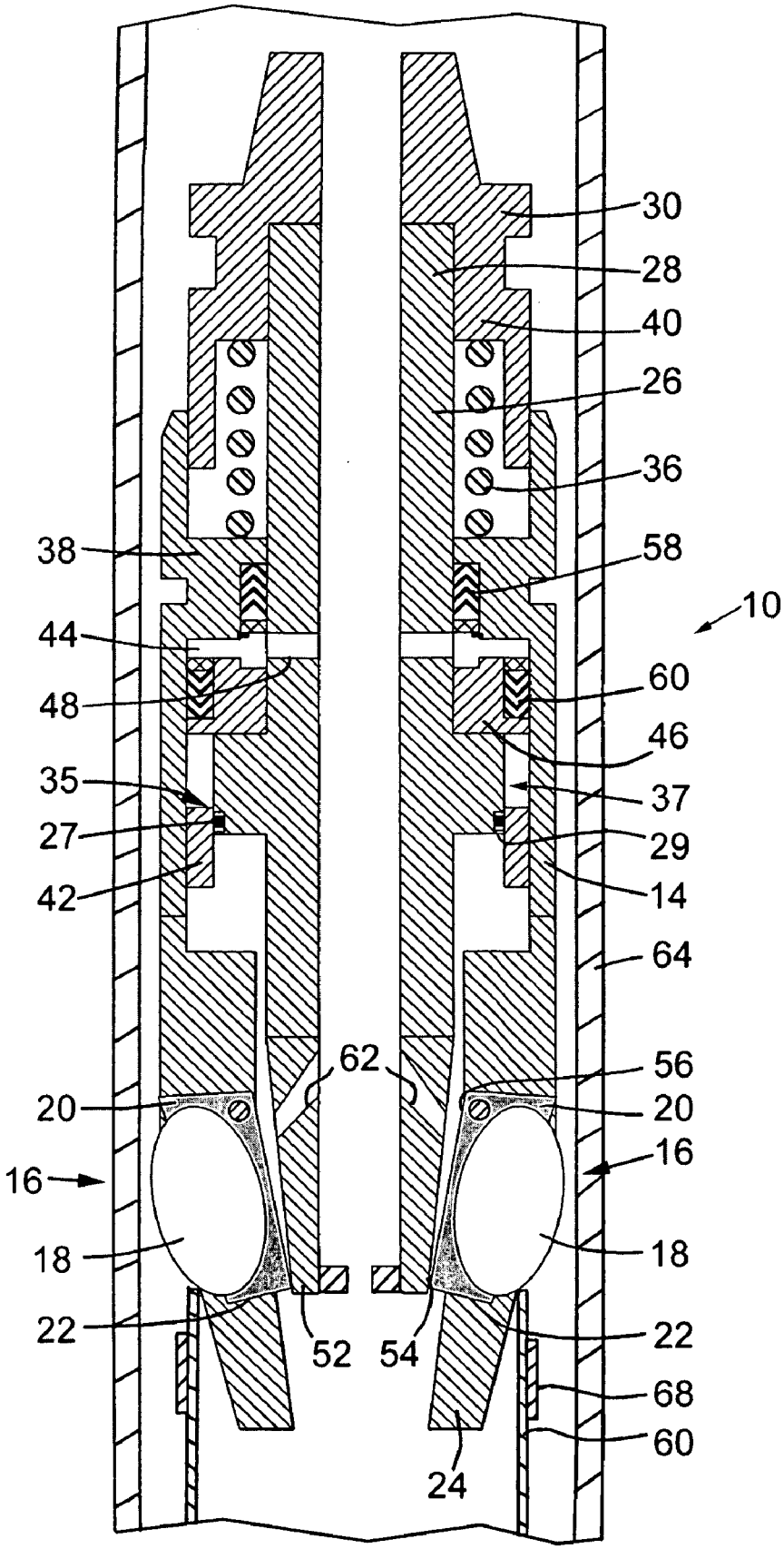
FIG. 3 is a view of the tubing expansion tool of FIG. 1, shown in the deactivated configuration in alternative tubing to be expanded.
Figure 4:
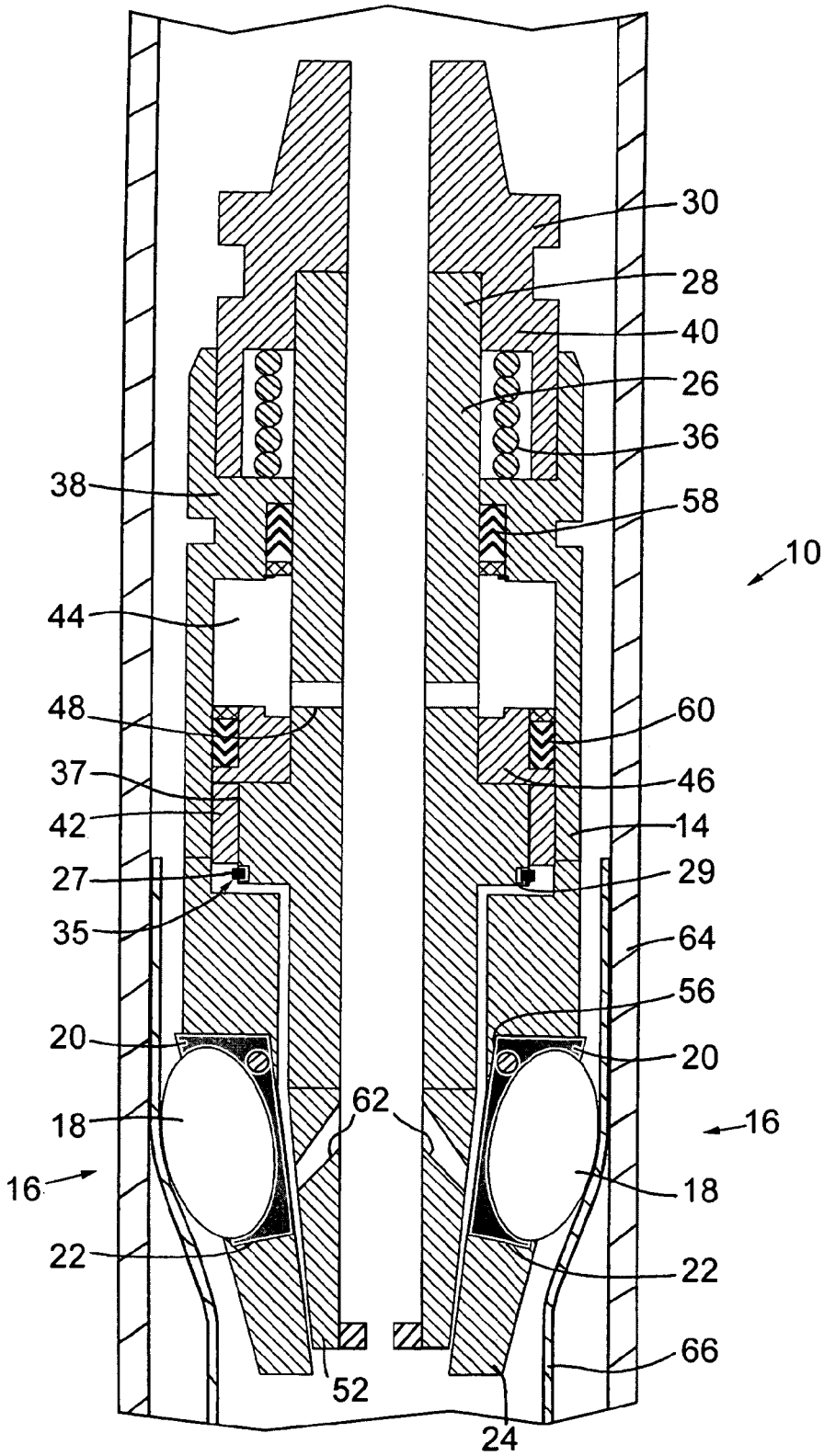
FIG. 4 is a view of the tubing expansion tool of FIG. 3 in the expanded configuration, drawn to a larger scale and shown during expansion of the tubing.

Turning now to FIGS. 3 and 4, an alternative method of operation of the tool 10 will be described.

FIG. 3 shows the tool 10 located in borehole casing 64, in the deactivated position. The tool 10 has been run into the casing 64 on a string together with expandable bore-lining tubing in the form of an expandable liner 66. An upper end of the liner 66 is shown in FIG. 3, and is located overlapping the casing 64, with a seal sleeve 68 provided on an outer surface of the liner 66, for sealing between the casing 64 and the liner 66.

When the liner 66 has been located in the desired position, the tool 10 is set down on the upper end of the liner 66 and weight is applied to the mandrel 26, through the connecting sub 30. This moves the mandrel 26 downwardly, forcing the rollers 18 outwardly to the expanded configuration, and the snap ring 27 locks the mandrel in the activating position and thus the rollers 18 in the extended configuration. The tool 10 is then rotated and advanced axially through the liner 66, diametrically expanding the liner into contact with the casing 64 as shown in FIG. 4. The tool 10 is advanced through the liner 66 to a desired depth, and then recovered to surface, as described above. The liner 66 is thus hung from the casing 64 and sealed relative to the casing 64 by the seal sleeve 68.

Figure 5:
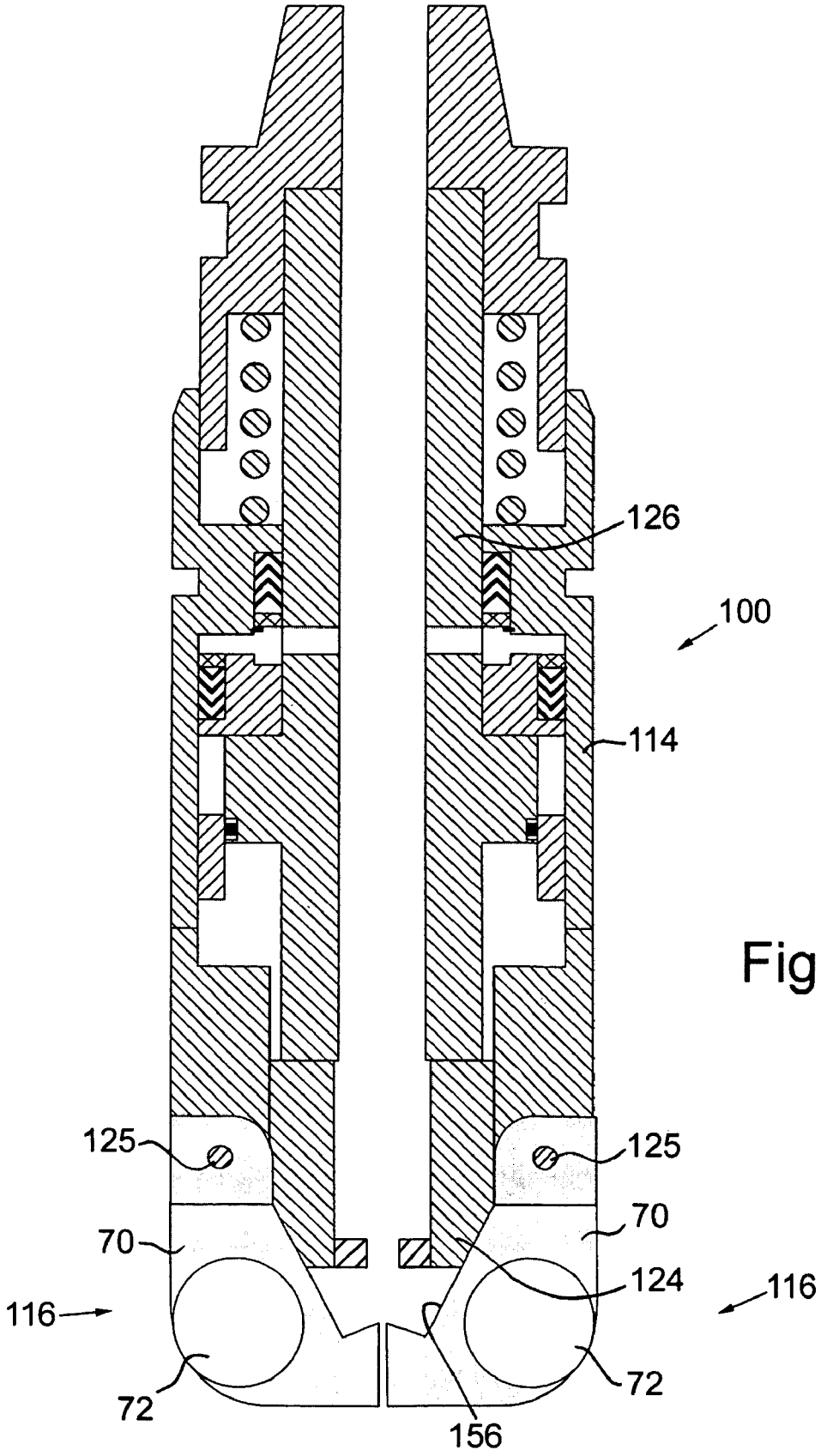
FIG. 5 is a longitudinal sectional view of a tubing expansion tool in accordance with an alternative embodiment of the present invention, shown in a deactivated configuration.

Turning now to FIG. 5, there is shown a tubing expansion tool in accordance with an alternative embodiment of the present invention, the tool indicated generally by reference numeral 100. Like components of the tool 100 with the tool 10 of FIG. 1 share the same reference numerals incremented by 100. For ease of reference, only the significant differences between the structure of the tool 100 with respect to the tool 10 will be described herein.

Figure 6:
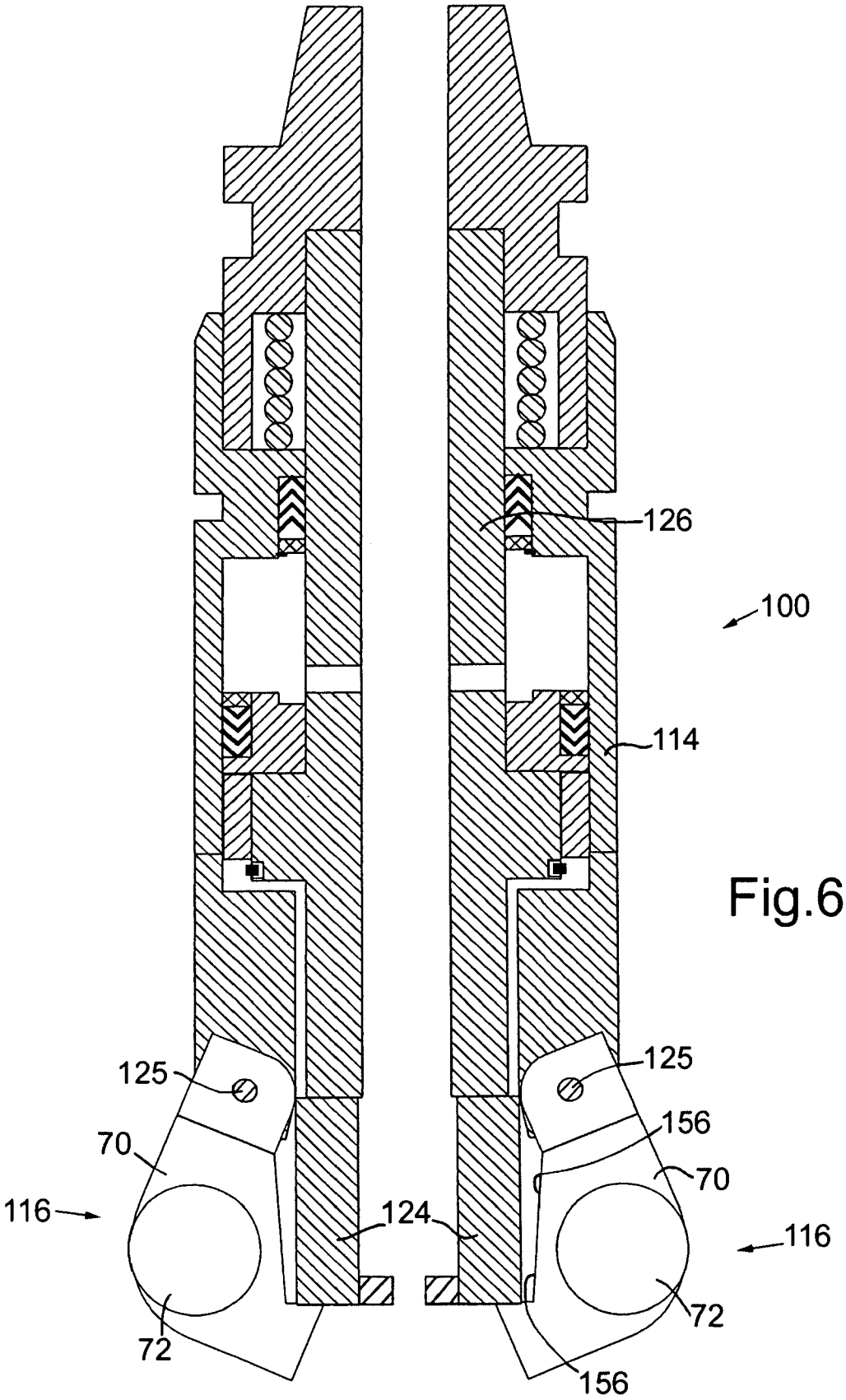
FIG. 6 is a view of the tubing expansion tool of FIG. 5, drawn to a larger scale and shown in an expanded configuration.

The tool 100 includes three expansion member assemblies 116, each comprising expansion arms 70 coupled to the tool body 114 by pivots 125 and an expansion ball 72 rotatably mounted to the arm 70 for expanding tubing. The arms 70 are spaced 120° apart and are moveable about the pivots 125 between the de-activated configuration of FIG. 5 and the expanded configuration of FIG. 6 in the same fashion as the tool 10. The mandrel 126 includes a cylindrical lower end 124 and each arm 70 includes an inner surface 156 which is recessed (not shown) to define a cam surface which abuts the mandrel lower end 124. As the mandrel 126 descends, the mandrel urges the arms 70, and thus the expansion balls 72, outwardly to the expanded configuration of FIG. 6.

Pivotably mounting the arms 70 on the body 114 in this fashion allows a high expansion ratio of the tubing as there is a relatively large movement of the expansion balls 72 between the de-activated and expanded configurations.

Figure 7:
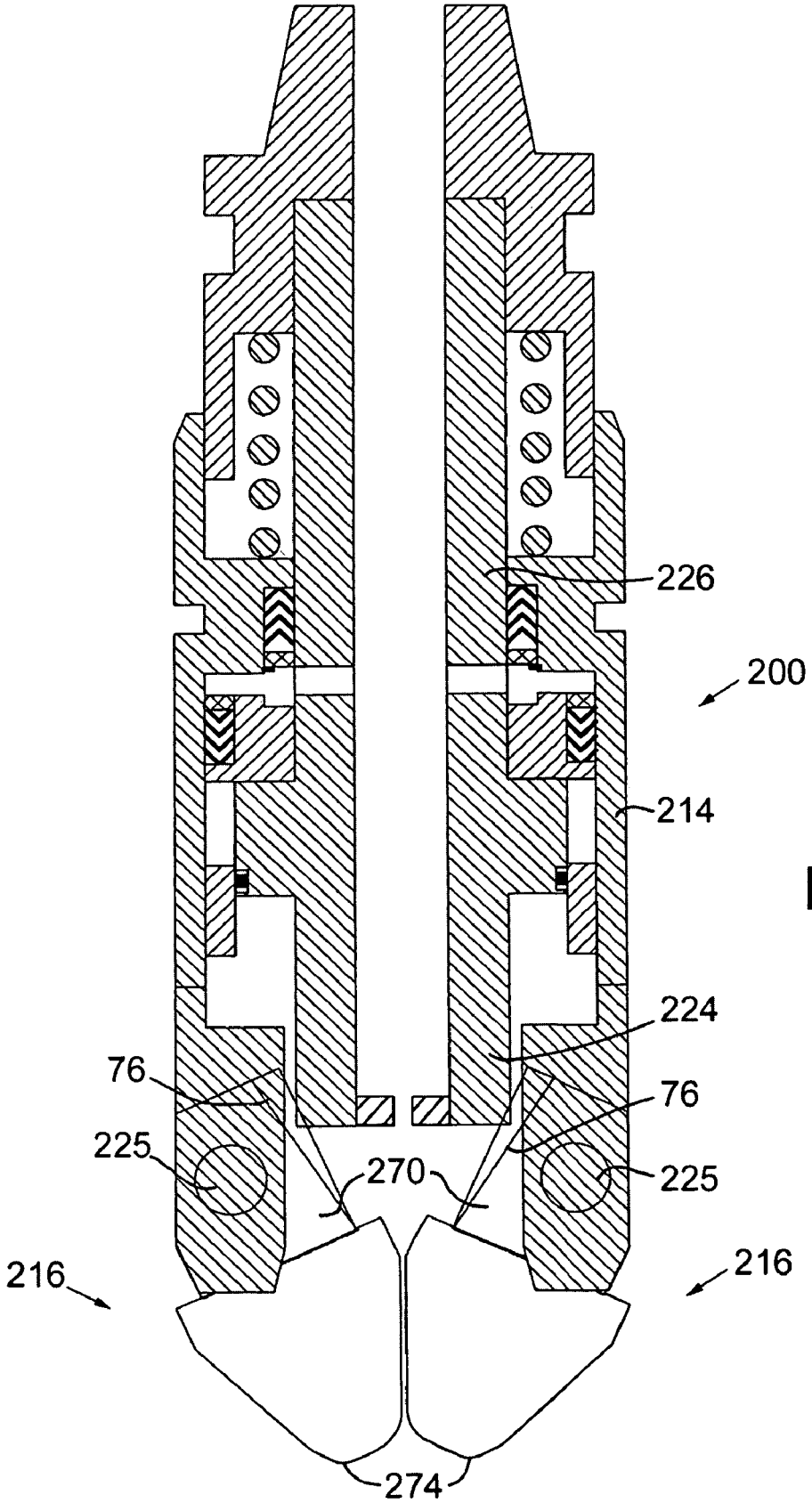
FIG. 7 is a longitudinal sectional view of a tubing expansion tool in accordance with a further alternative embodiment of the present invention, shown in a de-activated configuration.
Figure 8:
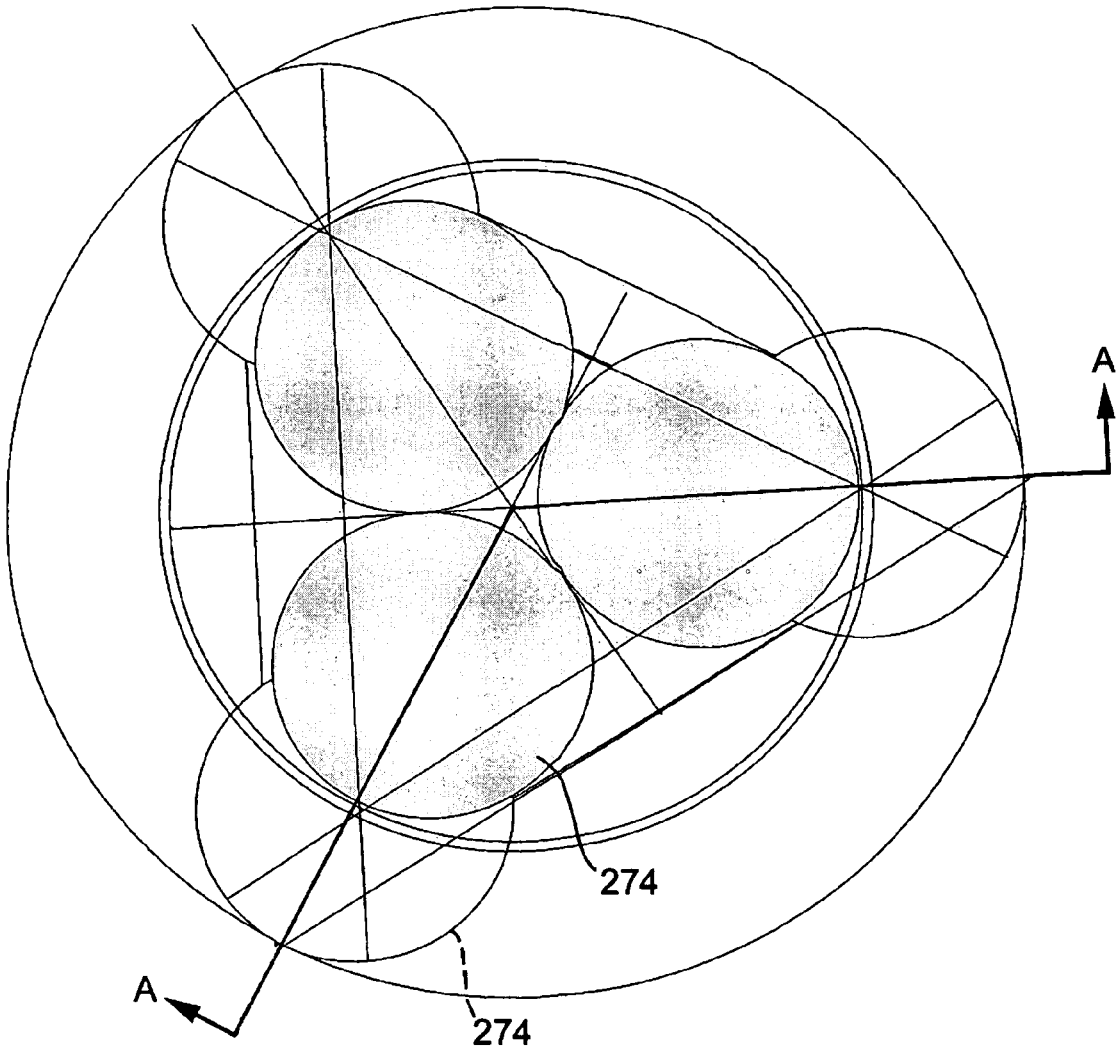
FIG. 8 is a schematic, bottom view of the tubing expansion tool of FIG. 7 showing expansion members of the tool in both the de-activated and the expanded configurations.

Turning now to FIG. 7, there is shown a tubing expansion tool in accordance with a further alternative embodiment of the present invention, the tool indicated generally by reference numeral 200. This view of the tool 200 corresponds to a section along line A-A of FIG. 8. It will be understood that the view of the tool 100 shown in FIG. 5 is sectioned in a similar fashion.

Like components of the tool 200 with the tool 10 of FIG. 1 share the same reference numbers incremented by 200. Again, only the main differences between the tool 200 and the tool 10 will be described herein.

Figure 9:
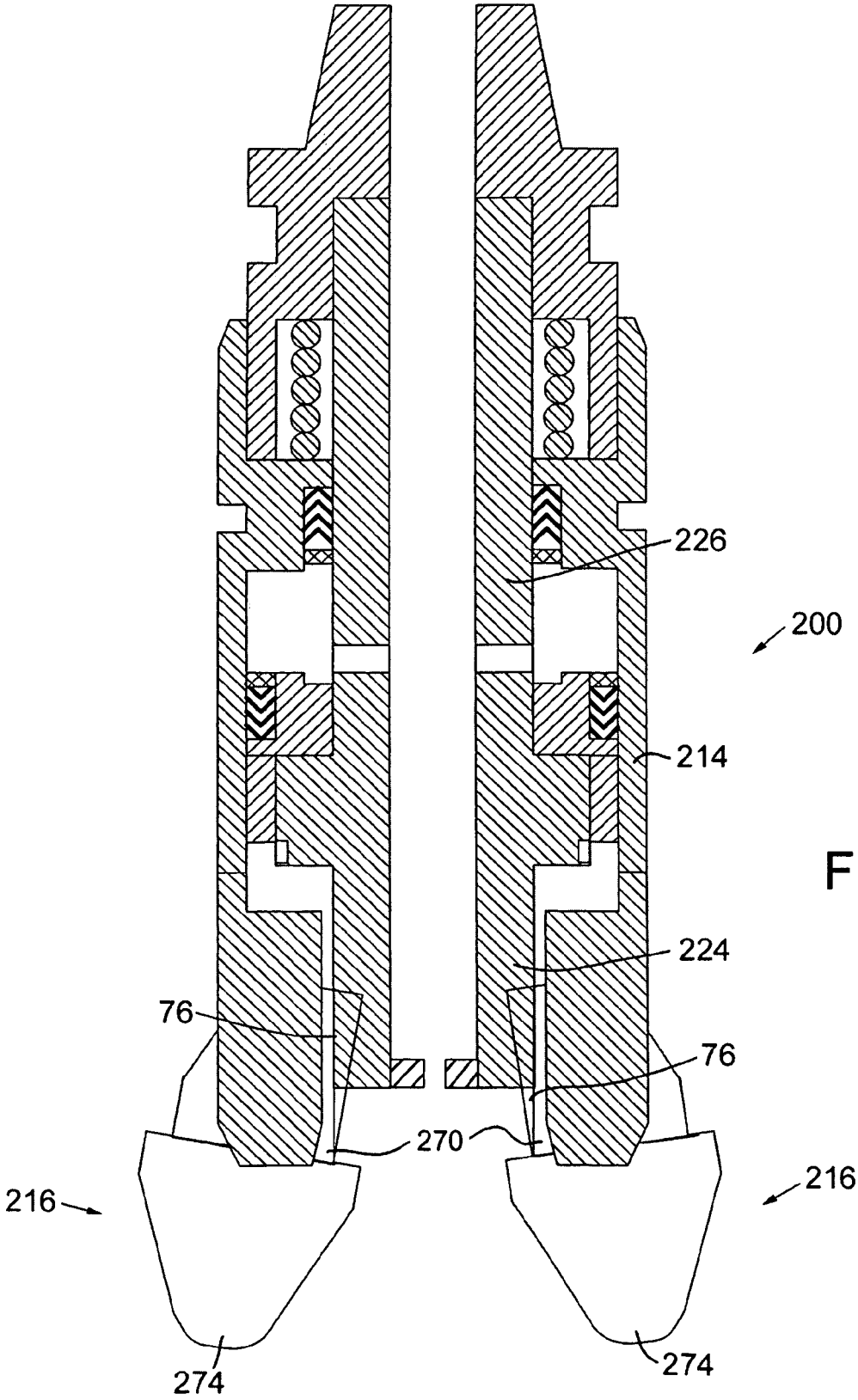
FIG. 9 is a view of the tubing expansion tool of FIG. 7, drawn to a larger scale and shown in an expanded configuration.

The tool 200 includes three expansion members 216 spaced 120° apart and including expansion arms 270 pivotably mounted to the tool body 214 by pivots 225. Tapered, truncated expansion cones 274 are rotatably mounted on spindles of the arms 270 for expanding tubing when the tool is moved to the expanded configuration of FIG. 9. Again, a high expansion ratio is achieved by the relatively large movement of the expansion members 216, as shown best in FIG. 8, the position of the cones 274 in the expanded configuration indicated by the broken reference line. The tool 200 is otherwise similar to the tool 100 of FIG. 5 and cam surfaces 76 defined by the arms 270 are illustrated in FIG. 7. These cam surfaces 76 abut the lower end 224 of the tool mandrel 226 during downward movement of the mandrel, to urge the expansion arms 270 outwardly to the expanded configuration.

In further embodiments of the present invention, the tools 10, 100 or 200 may be activated through a combination of mechanical force applied to the respective tool mandrel and through circulation of fluid through the tool bore to force the mandrel downwardly.

In still further embodiments of the present invention, the expansion tools 10, 100 or 200 may be deployed as part of a string including a rotary expansion tool of the type disclosed in International Patent Publication No. WO00/37766. For example, one of the expansion tools 10, 100 or 200 may be disposed in a string including a rotary expansion tool of the type disclosed in WO00/37766. The expansion tool of WO00/37766 may be used to create an initial, partial expansion of the tubing 12 during movement of the string through tubing to be expanded, to hang the tubing, in the form of liner carrying a seal from a larger diameter casing. The expansion tool 10, 100 or 200 is then fully activated as described above, to expand the tubing to a determined diameter, by passing the tool down through the tubing to a desired depth. The tool is also passed through the interface between the casing and liner, to ensure the liner and the seal are expanded to the correct predetermined diameter, thus confirming integrity of the connection. Use of a string including both such expansion tools offers flexibility of operation in the downhole environment.

Various modifications may be made to the foregoing within the scope of the present invention.

For example, the tool may only include locking means or biasing means. The tool may be mechanically activated in any alternative fashion suitable for moving the mandrel down relative to the body. For example, the tool mandrel may be urged downwardly relative to the tool body by restraining the body and setting weight down on the mandrel.

The snap ring may alternatively be disengaged downhole, such that the biasing spring returns the sub and mandrel to the de-activated position. This de-supports the rollers, which are now no longer able to exert an expansion force on the tubing, allowing the expansion tool to be returned to surface more easily. The snap ring may be released downhole by a release assembly such as release sleeve moved over the snap ring to cam the ring into the ring slot, allowing movement of the mandrel past the guide ring. Alternatively, the tool may include dogs or pins for moving the snap ring inwardly. In a further alternative, the snap ring may simply be sheared out.

The mandrel may define a piston in place of a floating annular piston mounted on a shoulder of the mandrel, the mandrel shoulder may define the piston. Thus, for example, the annular piston 46 of the tool 10 may comprise an integral part of or may be coupled to the mandrel shoulder 37.

The tool may be run on jointed tubing and may be driven from surface by a kelly or top drive.

Where the expansion members 16 of the tool 10 are mounted on pivots 25, movement of the mandrel 26 downwardly may rotate the rollers 18 about the pivot 25 such that the rollers 18 describe an expanded diameter for expanding tubing, in a similar fashion to the tools 100 and 200 of FIGS. 5 to 9.

Where the tools are activated by fluid pressure, the respective tool mandrel may be urged downwardly either by providing the mandrel with a restriction nozzle to create a back pressure, or by defining a differential piston area across the floating annular piston, or by a combination of the two, as described above.

The expansion member may be inclined with respect to the body of the tool and may be inclined towards a leading end of the tool, that is, tapering towards said leading end. Indeed, where, for example, the expansion members 18 of the tool 10 shown in FIG. 1 are not pivotally mounted to the tool body, it will be understood that the expansion members are effectively so inclined.

The invention claimed is:

1. A tubing expansion tool comprising:

a body;

at least one expansion member radially movably mounted on the body for movement towards an extended configuration describing an expansion diameter;

an activating member movable within the body and having an activating position in which the activating member urges the expansion member towards the extended configuration; and a locking assembly for locking the activating member in the activating position to maintain the expansion member in the extended configuration.

2. A tool as claimed in claim 1, wherein the activating member is mechanically lockable in the activating position.

3. A tool as claimed in claim 1, wherein the activating member is hydraulically lockable in the activating position.

4. A tool as claimed in claim 1, wherein the activating member is electro-mechanically lockable in the activating position.

5. A tool as claimed in claim 1, wherein the locking assembly is releasable.

6. A tool as claimed in claim 1, wherein the activating member is mounted in the body and axially movable relative to the body.

7. A tool as claimed in claim 1, wherein the activating member is moveable between a deactivating position and the activating.

8. A tool as claimed in claim 7, further comprises a spring configured to bias the activating member towards the deactivating.

9. A tool as claimed in claim 1, wherein the locking assembly comprises a locking member adapted to engage the activating member when the activating member is in the activating position, to restrain the activating member.

10. A tool as claimed in claim 1, wherein the locking assembly comprises a locking member coupled to the activating member and adapted to engage the body when the activating member is in the activating position, to restrain the activating member.

11. A tool as claimed in claim 1, wherein the activating member comprises a mandrel having a cam surface, the cam surface urges the expansion member to the extended configuration while the mandrel moves axially relative to the body.

12. A tool as claimed in claim 11, further comprising a connecting sub coupled to the mandrel, wherein the connecting sub allows a mechanical force to be exerted on the mandrel to move the expansion member to the extended configuration.

13. A tool as claimed in claim 11, wherein the locking assembly comprises a locking member coupled to a groove in the mandrel and adapted to engage the body.

14. A tool as claimed in claim 1, wherein the activating member includes a cam surface for urging the expansion member to the extended configuration.

15. A tool as claimed in claim 1, wherein, in use, the expansion member describes an unexpanded diameter greater than the unexpanded inner diameter of the tubing.

16. A tool as claimed in claim 1, wherein, in use, the expansion member describes an unexpanded diameter less than an unexpanded inner diameter of the tubing.

17. A tool as claimed in claim 1, wherein the expansion member is pivotable relative to the body.

18. A tool as claimed in claim 17, wherein the expansion member is pivotably mounted to the body.

19. A tool as claimed in claim 18, further comprising an arm pivotably mounted to the body, the expansion member mounted for rotation with respect to the arm.

20. A tool as claimed in claim 1, wherein the tool is a downhole tool for expanding downhole tubing.

21. A tool as claimed in claim 1, wherein the expansion member is rotatable about an expansion member axis, and wherein the expansion member axis is inclined with respect to the body of the tool.

22. A tool as claimed in claim 21, wherein the expansion member axis is inclined towards a leading end of the tool.

23. A method of expanding tubing, the method comprising the steps of:

providing a tubing expansion tool comprising a body, at least one expansion member movably mounted on the body, and an activating member for moving the expansion member;

moving the expansion member radially outwardly to an extended configuration describing an expansion diameter;

locking the activating member using a locking assembly when the expansion member is in the extended configuration; and moving the expansion tool through tubing to be expanded.

24. A method as claimed in claim 23, wherein the expansion member is released from the extended configuration after removal of the tool from the tubing.

25. A method as claimed in claim 23, wherein the expansion member is released from the extended configuration whilst the tool is in the tubing.

26. A method as claimed in claim 23, further comprising:

translating the tool through a restriction defining an internal bore diameter smaller than said expansion member expansion diameter; and then moving the expansion member radially outwardly to said extended configuration.

27. A method as claimed in claim 26, comprising translating the tool through a restriction in an unlined portion of a borehole.

28. A method as claimed in claim 26, comprising translating the tool through a restriction in the tubing.

29. A method as claimed in claim 23, comprising expanding an end of the tubing to a greater diameter than a remainder of the tubing.

30. A method as claimed in claim 29, comprising forming a bell-bottom in the tubing.

31. A method as claimed in claim 29, further comprising locating a further tubing in said end of the tubing.

* * * * *